US006114676A

United States Patent [19]

Jerby et al.

[11] Patent Number: 6,114,676

[45] Date of Patent: Sep. 5, 2000

[54] METHOD AND DEVICE FOR DRILLING, CUTTING, NAILING AND JOINING SOLID NON-CONDUCTIVE MATERIALS USING MICROWAVE RADIATION

[75] Inventors: Eli Jerby, Rishon L'Zion; Vladimir Dikhtiar, Ashdod, both of Israel

[73] Assignee: Ramut University Authority for Applied Research and Industrial Development Ltd., Tel Aviv, Israel

[21] Appl. No.: 09/232,674

[22] Filed: Jan. 19, 1999

[51] Int. Cl.[7] ..... H05B 6/72; H05B 6/80

[52] U.S. Cl. ..... 219/690; 219/384; 219/695; 219/748; 83/15; 83/170

[58] Field of Search ..... 219/690, 691, 219/695, 679, 746, 748, 749, 384; 299/14; 83/15, 16, 170

[56] References Cited

U.S. PATENT DOCUMENTS

| | | | |
|---|---|---|---|
| 3,219,280 | 11/1965 | Seldenrath et al. | 219/690 |
| 3,430,021 | 2/1969 | Watson | 219/691 |
| 3,443,051 | 5/1969 | Puschner | 219/748 |
| 3,532,847 | 10/1970 | Puschner | 219/748 |
| 4,370,534 | 1/1983 | Brandon | 219/738 |
| 4,571,473 | 2/1986 | Wyslouzil et al. | 219/748 |
| 5,003,144 | 3/1991 | Lindroth et al. . | |
| 5,026,959 | 6/1991 | Ito et al. | 219/690 |
| 5,369,251 | 11/1994 | King et al. | 219/690 |
| 5,449,889 | 9/1995 | Samardzija | 219/748 |
| 5,635,143 | 6/1997 | White et al. . | |

OTHER PUBLICATIONS

Metaxas AC, "Foundations of Electroheat", *John Wily & Sons,* 1996, pp. 406–432.

Iskander et al, Eds., "Microwave Processing of Materials V", *Materials Res. Soc.,* vol. 430, pp. 295–301, 345–350, 1996.

*Primary Examiner*—Philip H. Leung
*Attorney, Agent, or Firm*—Mark M. Friedman

[57] ABSTRACT

A microwave device and corresponding method for cutting, and especially drilling into, a solid body of non-conductive material employ a microwave source which provides microwave radiation, typically through a waveguide, to a concentrator. The concentrator is configured to concentrate the microwave radiation onto a small region of solid body, thereby generating sufficient heat in that region to liquefy a volume of the material to form a hole. The device and method may be used to perform various drilling, cutting, nailing, joining and welding operations on a wide range of dielectric materials including ceramics, concrete and stone.

30 Claims, 8 Drawing Sheets

FIG.10A
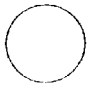
FIG.10B
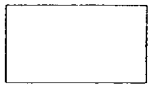
FIG.10C
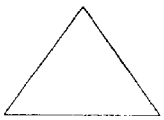
FIG.10D
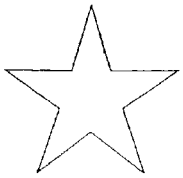
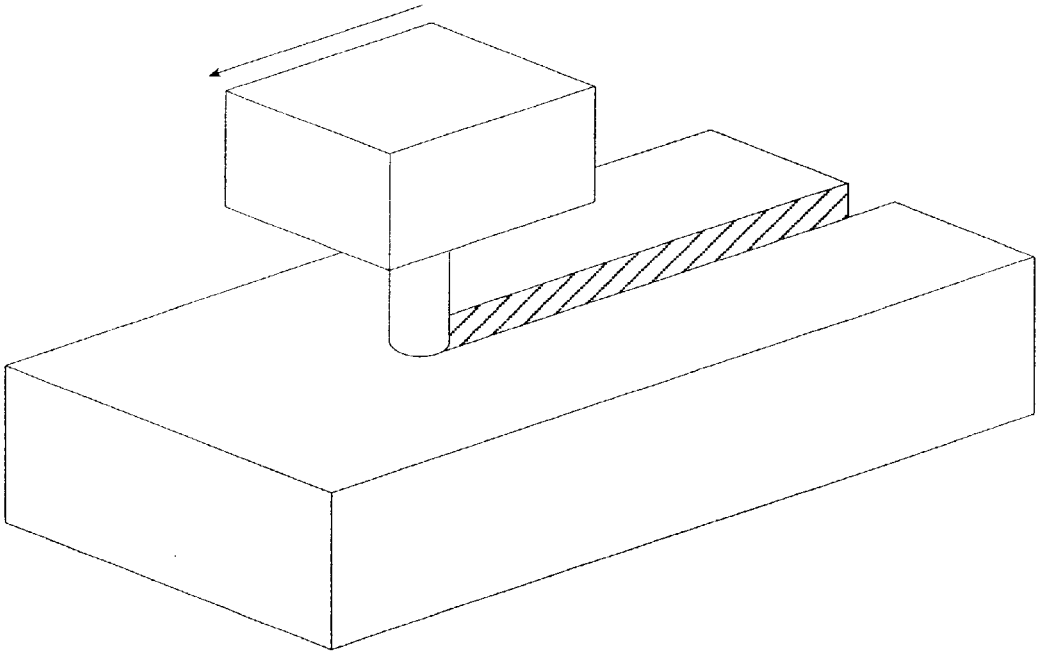
FIG.11

METHOD AND DEVICE FOR DRILLING, CUTTING, NAILING AND JOINING SOLID NON-CONDUCTIVE MATERIALS USING MICROWAVE RADIATION

FIELD AND BACKGROUND OF THE INVENTION

The present invention relates to cutting of materials and, in particular, it concerns a method and device employing microwave radiation to cut into non-conductive materials.

One of the most fundamental and most frequently performed mechanical operations is the drilling of holes. Of particular relevance here is the drilling of holes in hard non-conductive materials such as stones, rocks, marble, silicates, ceramics, concrete, brick etc. which is required in a wide range of applications including almost all machining and construction work.

Drilling of holes in such materials is typically performed by use of mechanical drills. The operation of mechanical drills is very noisy and generates large amounts of dust which may be damaging to equipment and harmful to people and the environment. Generation of dust also requires costly cleaning.

There exist laser-based cutting systems in which a laser is used to drill holes in various materials. An example of such a system is described in A. C. Metaxas, "Foundations of Electroheat", John Wiley and Sons, 1996. These lasers operate mainly in the infrared range (primarily $CO_2$ lasers at 10.6 $\mu$m wavelength). Laser based systems provide a non-mechanical alternative for making small accurate holes. However, these devices are relatively expensive and are not suitable for general purpose use.

In the field of microwave engineering, devices have been proposed for a wide range of manufacturing and treating processes. These include consolidation of materials, sintering of ferrites and ceramics, dewaxing of casting molds, fast setting of concrete and asphalt, and gluing processes. Most of these applications are implemented inside special microwave furnaces or applicators.

It has also been known for several years that thermal fluctuations caused by high-power microwaves may be used to fracture rocks and concrete. Examples of such applications are described in U.S. Pat. Nos. 5,003,144 to Lindroth et al. and 5,635,143 to White et. al. However, microwaves do not seem to have been used directly for drilling holes in a solid body.

It is also known that an open-ended coaxial applicator may be used for joining of ceramic sheets. Such a device is described by Tinga et al., "Open Coaxial Microwave Spot Joining Applicator", Ceramic Transactions 1995, Vol. 59, pp. 347–355. The applicator described therein may be effective to cause a localized hot spot which can be used to join elements. However, the end of the suggested applicator structure is covered by a dielectric plate, rendering it incapable of drilling or cutting into the material.

There is therefore a need for a method and device employing microwave radiation to drill into or otherwise cut non-conductive materials.

SUMMARY OF THE INVENTION

The present invention is a method and device employing microwave radiation to cut non-conductive materials.

According to the teachings of the present invention there is provided, a method for drilling a hole in a non-conductive solid body, the method comprising: (a) generating microwave radiation; and (b) concentrating the microwave radiation onto a small region of the solid body so as to generate heat sufficient to remove a volume of the solid body, thereby forming a hole in the solid body.

According to a further feature of the present invention, the small region has substantially circular symmetry.

According to a further feature of the present invention, the microwave radiation has a given wavelength, the small region having at least one dimension which is smaller than the wavelength.

According to a further feature of the present invention, the microwave radiation is concentrated by use of a microwave concentrator, the concentrator being formed as a waveguide having at least one inner conductor and an outer conductive sheath surrounding the inner conductor, wherein the outer conductive sheath terminates at an open end and the inner conductor extends beyond the open end.

According to a further feature of the present invention, the microwave radiation has a given wavelength, the at least one inner conductor having a transverse dimension which is smaller than the wavelength.

According to a further feature of the present invention, the at least one inner conductor has a central axis and end, a cross-section taken through the at least one inner conductor perpendicular to the central axis at a position proximal to the end exhibiting a non-circular outline.

According to a further feature of the present invention, the concentrator further includes a dielectric sleeve surrounding at least part of the inner conductor.

According to a further feature of the present invention, the dielectric sleeve extends beyond the open end.

According to a further feature of the present invention, the dielectric sleeve substantially fills a volume between the inner conductor and the outer conductive sheath.

According to a further feature of the present invention, the inner conductor and the outer conductive sheath are coaxial.

According to a further feature of the present invention, at least a part of the outer conductive sheath adjacent to the open end is telescopically mounted relative to the inner conductor such that a distance of extension of the inner conductor beyond the open end may be varied.

According to a further feature of the present invention, the outer conductive sheath is retracted relative to the inner conductor so as to increase the distance of extension and advancing the inner conductor into the hole so as to deepen the hole.

According to a further feature of the present invention, a part of the concentrator is inserted into the hole, the method further comprising generating rotation of at least the part of the concentrator so as to enhance removal of molten material from the hole.

According to a further feature of the present invention, the part of the concentrator is formed with an external helical groove configured to enhance removal of molten material from the hole.

According to a further feature of the present invention, the region onto which the microwave radiation is concentrated is changed so as to extend the hole formed in the solid body.

According to a further feature of the present invention, the region onto which the microwave radiation is concentrated is changed so as to deepen the hole.

According to a further feature of the present invention, a second solid body is brought into contact with the melted material and allowing the material to solidify, thereby welding the second solid body within the hole.

According to a further feature of the present invention, the second solid body forms at least part of a microwave concentrator used to concentrate the microwave radiation.

According to a further feature of the present invention, a location of concentration of the microwave radiation is displaced across the solid body so as to enlarge the hole to form an elongated channel.

There is also provided according to the teachings of the present invention, a microwave device for cutting non-conductive materials, the device comprising: (a) a microwave source of microwave radiation; and (b) concentrator means coupled to the microwave source so as to receive the microwave radiation, the concentrator means being configured to concentrate the microwave radiation onto a small region of the non-conductive material, wherein the concentrator means is formed with at least one inner conductor and an outer conductive sheath surrounding the inner conductor, and wherein the outer conductive sheath terminates at an open end and the inner conductor extends beyond the open end.

According to a further feature of the present invention, the microwave source generates microwave radiation of a given wavelength, and wherein the concentrator means is configured such that, when placed adjacent to the non-conductive material, a majority of the microwave radiation is directed into a volume of the material lying within a virtual cylinder of diameter equal to half of the wavelength.

According to a further feature of the present invention, the concentrator means further includes a dielectric sleeve surrounding at least part of the inner conductor.

According to a further feature of the present invention, the dielectric sleeve is configured to disconnect from the concentrator means such that the dielectric sleeve remains inserted in the material as a hole lining.

According to a further feature of the present invention, the dielectric sleeve extends beyond the open end.

According to a further feature of the present invention, the dielectric sleeve substantially fills a volume between the inner conductor and the outer conductive sheath.

According to a further feature of the present invention, the inner conductor and the outer conductive sheath are coaxial.

According to a further feature of the present invention, at least a part of the outer conductive sheath adjacent to the open end is telescopically mounted relative to the inner conductor such that a distance of extension of the inner conductor beyond the open end may be varied.

According to a further feature of the present invention, the inner conductor is configured to disconnect from the concentrator means such that the inner conductor remains inserted in the material as a projecting nail.

According to a further feature of the present invention, there is also provided a rotational drive mechanism associated with the concentrator means so as to generate rotation of at least the inner conductor.

According to a further feature of the present invention, at least one part of the concentrator means is formed with an external helical groove.

BRIEF DESCRIPTION OF THE DRAWINGS

The invention is herein described, by way of example only, with reference to the accompanying drawings, wherein:

FIGS. 10A–10D illustrate a number of alternative cross-sections for an inner conductor for use in the devices of the present invention; and FIG. 11 is a schematic isometric representation of an application of the present invention for cutting grooves.

DESCRIPTION OF THE PREFERRED EMBODIMENTS

The present invention is a method and device employing microwave radiation to cut non-conductive materials.

The principles and operation of methods and devices according to the present invention may be better understood with reference to the drawings and the accompanying description.

Figure 1:
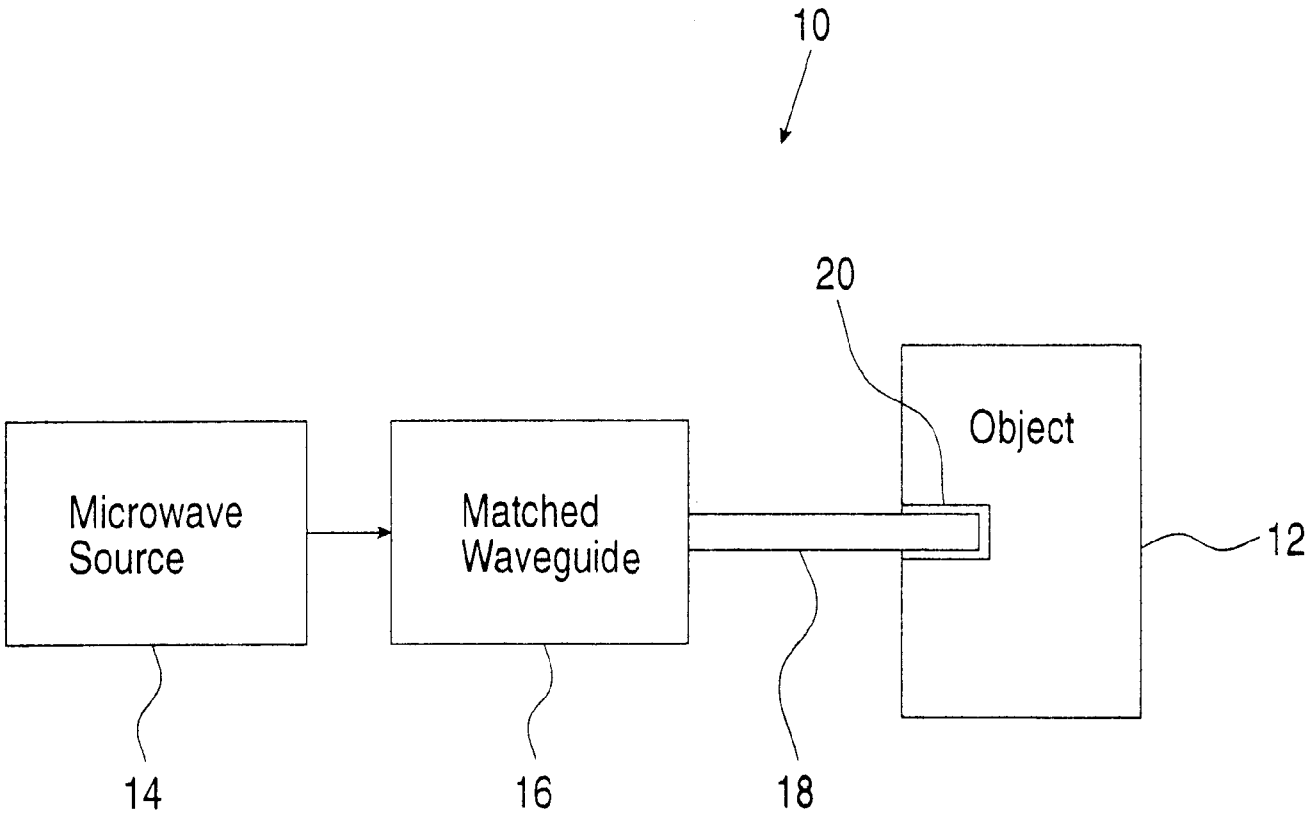
FIG. 1 is a schematic representation of a microwave device, constructed and operative according to the teachings of the present invention, for drilling a hole in a solid body.

Referring now to the drawings, FIG. 1 shows schematically a microwave device, generally designated 10, constructed and operative according to the teachings of the present invention, for cutting a solid body 12 of non-conductive material.

Generally speaking, microwave device 10 includes a microwave source 14 which provides microwave radiation, typically through a waveguide 16, to a concentrator 18. Concentrator 18 is configured to concentrate the microwave radiation onto a small region of solid body 12. When microwave source 14 is activated, the microwave radiation directed by concentrator 18 generates sufficient heat in the small region to liquefy a volume of the material, thereby forming a hole 20 in solid body 12. The inner surface of the melted hole solidifies quickly to a form of a glossy coating.

It will immediately be appreciated that microwave device 10 provides an attractive non-mechanical alternative to mechanical drills for creating narrow holes in a wide range of non-conductive materials. Unlike mechanical drills, the operation of the device is completely quiet, not requiring rotating parts, or any causes of mechanical friction. The device does not produce any dust, and is therefore a more "environmental friendly" tool. Regarding microwave safety, its radiation emission can be limited to strict international standards by use of grid screens, graphite absorbers and the like as required for each application. Such precautions are well within the ability of one ordinarily skilled in the art. The device is simple and inexpensive to implement. Various implementations are envisaged both for specialized industrial production lines, or as general-purpose tools.

The invention is applicable to a wide range of materials which are referred to as hard, non-conductive materials. More specifically, the operation of concentrator 18 is most effective when brought into close proximity, and preferably into contact, with a material of which the dielectric loss factor $\epsilon''$ increases with rising temperature. This results in an enhanced coupling effect in which microwave power absorption is highly focused at a "hot-spot" in the target region. This effect parallels the "thermal run-away" effect known to be highly problematic in microwave furnaces. Examples of materials exhibiting this property include, but are not limited to, stone, rock, marble, silicates, ceramics, alumina, concrete, bricks of various kinds, basalt, plastics, wood and cellulose-based materials. The invention is also particularly significant in its ability to drill by localized melting, vaporization or combustion of materials with melting temperatures over about 300° C., and more particularly, in excess of about 1200° C., and even in excess of about 1500° C.

In addition to the basic operation as a microwave drill, the device has many other applications. Firstly, part or all of concentrator 18 may be moved forward into hole 20 so as to continue the heating and drilling process inside the hole to the desired depth. Alternatively, or additionally, by generating transverse relative motion between the device and the material being cut, the device can operate as a grooving tool or as a microwave saw. It should be noted that all such drilling, sawing and other cutting operations are referred to collectively herein as "cutting".

The ability to achieve controlled localized melting of materials such as stone, concrete and ceramics opens up a range of additional applications for welding and joining materials in a highly effective permanent manner. For example, a ceramic pipe can be inserted into the hole during the drilling process and remain welded as an inner coating of the hole. Similarly, a metallic nail can be inserted into the material and become permanently attached inside the hole. The device can also be used as a microwave welder to join two bodies together without application of separate "solder" material. This latter process may be performed on materials so diverse as glass-concrete and glass-stone junctions, allowing direct "welding" of window panels into structural materials.

Other applications include, but are not limited to, industrial drilling systems for use in production lines, drills for use in a wide range of applications such as geological surveys, oil production, mining and stone cutting, in the electronics industry such as for cutting ceramic substrates for electronic circuits or such as drilling, nailing and metalization of solid-state chips made of Galium-Arsenide, in the ceramics industry including preparation of ceramics for dental applications, and in the construction industry such as for drilling concrete. In this last case, one particularly significant application is as a tool for reinforcement of concrete by insertion of metal rods.

Another particularly valuable application, illustrated schematically in FIG. 11, is for forming grooves or channels in the surfaces of surfaces such as concrete walls. Thus, a device according to the present invention may be moved across a wall manually or by any suitable displacement mechanism to form a channel into which wires, cables or the like can be inserted. This offers a quiet and dust-free alternative to the conventional mechanical techniques such as chiseling which cause great noise, dust and inconvenience.

Before turning to the features of device 10 in more detail, it should be appreciated that the word "microwave" in the context of the present invention is used to denote a wide range of frequencies of the electromagnetic spectrum ranging from the edge of the radio frequency band to the millimeter-wave band. In numerical terms, the invention is considered applicable to microwave frequencies in the range from about 100 MHz up to about 200 GHz.

Figure 2:
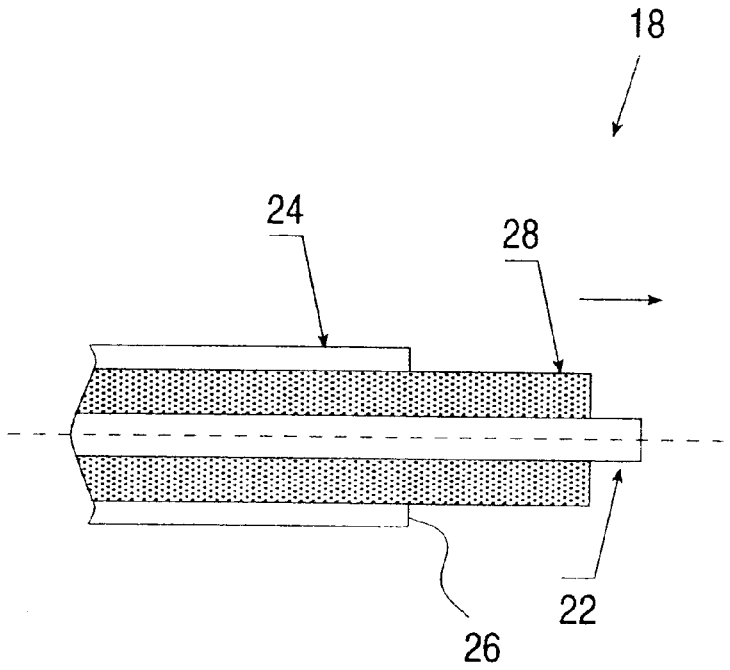
FIG. 2 is a cross-sectional view taken through a first implementation of a microwave concentrator for use in the device of FIG. 1.
Figure 3:
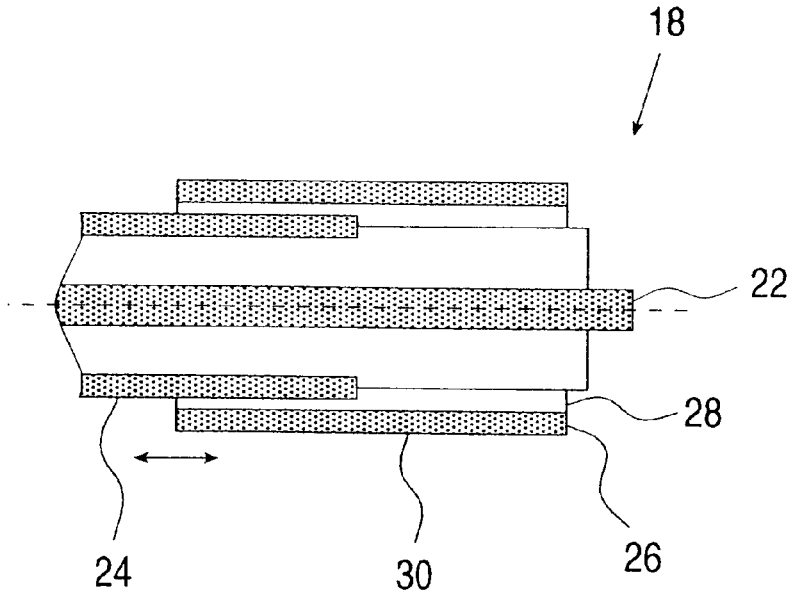
FIG. 3 is a cross-sectional view taken through a third implementation of a microwave concentrator for use in the device of FIG. 1.

Turning now to FIGS. 2–4, a number of implementations of concentrator 18 will now be described. Concentrator 18 may be implemented in any form which achieves near-field coupling with an adjacent dielectric material in a focused manner. For sawing-type applications, concentrator 18 may be configured to focus the radiation in one dimension while allowing it to fan-out in another, thereby heating a "slice" of the material. For drilling and other associated applications, concentrator 18 is preferably configured such that a majority of the microwave radiation is directed into a volume of the material lying within a virtual cylinder of diameter about half of the wavelength, and most preferably, of diameter less than about a tenth of the wavelength. The cross-sectional area corresponding to the former of these definitions is used herein in the specification and claims as a preferred definition of a "small region" of the material. This generally corresponds to an area of less than about 10 $cm^2$ for a standard 2.45 GHz generator. However, when enhanced "hot-spot" coupling occurs, the region of concentration of the radiation may be reduced in size by one or two orders of magnitude.

In one set of preferred implementations of concentrator 18, represented in FIG. 2, at least one inner conductor 22 is surrounded by an outer conductive sheath 24. Inner conductor 22 extends beyond an open end 26 of outer conductive sheath 24. This structure acts as a transmission-line section which guides the microwave radiation and focus it into the desired region on the material surface. The focusing effect is preferably enhanced by provision of a dielectric sleeve 28 surrounding at least part of inner conductor 22, preferably beyond open end 26. In the implementation shown here, dielectric sleeve 28 substantially fills the volume between inner conductor 22 and outer conductive sheath 24, thereby also serving to unify the structure of concentrator 18.

Inner conductor 22 may be made from a range of materials including, but not limited to, metals such as tungsten, stainless steel, iron, brass or copper, graphite and conductive ceramics such as silicon carbide, or any combination thereof. The material for a given application should be selected primarily on the basis of its melting temperature compared to that of the drilled material.

Dielectric sleeve 28 is typically made from various materials including, but not limited to, alumina, zirconia, and high-refractive ceramics. Optionally, sleeve 28 is covered by a graphite or silicon carbide coating.

Implementations of concentrator 18 can be implemented with two or more inner conductors 22, in symmetrical or asymmetrical configurations. However, the preferred implementation shown here employs a single inner conductor 22 deployed coaxially within a cylindrically formed outer conductive sheath 24. This structure is particularly convenient because of its easy integration with a coaxial waveguide connection.

It should be noted that the physical dimensions and shapes of the various components of concentrator 18 are determined according to the specific application and materials. By way of example, if microwaves of wavelength 12 cm are to be used to drill holes having a diameter of about 0.5 cm, a typical implementation could employ an inner conductor 22 of diameter about 2 mm, and an outer conductive sheath 24 of diameter about 2 cm.

As mentioned before, a hole 20 formed initially may be made deeper by moving forward part or all of concentrator 18 to a position within the hole. For deep drilling applications, the entirety of concentrator may penetrate into hole 20. More commonly, outer conductive sheath 24 remains outside hole 20. One particularly advantageous implementation of concentrator 18 for such applications is shown in FIG. 3.

In this case, a part 30 of outer conductive sheath 24 adjacent to open end 26 is telescopically mounted relative to inner conductor 22. This allows the distance of extension of inner conductor 22 beyond open end 26 to be varied. Typically, telescopic part 30 will initially be positioned in a forward position, retracting as inner conductor advances within hole 20. Dielectric sleeve 28 may also be axially slidable so as to be telescopic, or may be fixed relative to inner conductor 22 as in the case illustrated here.

Figure 4A:
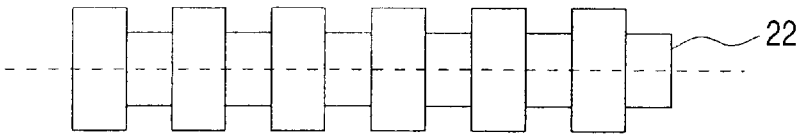
FIG. 4A is a side view of an inner conductor from a fourth implementation of a microwave concentrator for use in the device of FIG. 1.

FIG. 4A shows an alternative form for inner conductor 22 employing a corrugated near-field antenna structure. This structure supports slow-wave propagation and excites evanescent modes in the transverse direction, thereby leading to focusing of the radiation energy in the vicinity of the drill.

Figure 4B:
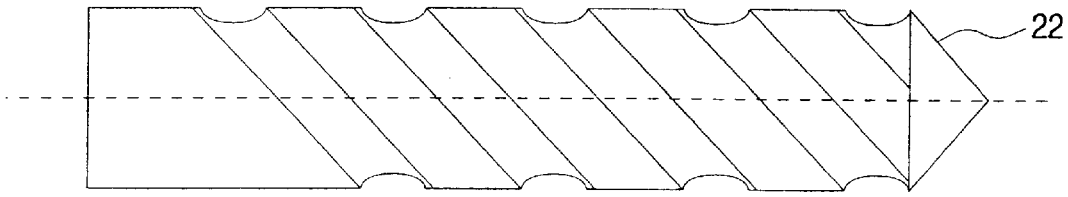
FIG. 4B is a side view of an inner conductor from a fifth implementation of a microwave concentrator for use in the device of FIG. 1.

Additional possibilities for variant implementations may employ axial rotation of inner conductor 22 alone, or together with sleeve 28, to enhance displacement of molten material from hole 20. This effect can be further enhanced by forming one or other of inner conductor 22 and sleeve 28 with a helical groove, as illustrated in FIG. 4B. This configuration has particular advantages, the resulting "corrugated" structure supporting slow waves which enhance focusing of the radiation while, at the same time, a slow mechanical rotation of the drill tends to carry molten material outwards to clear the hole. The drill is preferably mounted to undergo a combined axial displacement and axial rotation in a combination screw-type motion so as to move gradually deeper into the hole as cutting proceeds.

As mentioned above, besides the basic drilling and cutting operations, devices according to the present invention may be used for a range of other operations including nailing, welding and joining. In certain preferred cases, these operations may be performed by leaving one or both of inner conductor 22 and dielectric sleeve 28 within hole 20 at the end of the drilling operation such that the molten material fuses with the inserted part and solidifies to form a strong permanent connection.

Figure 5A:
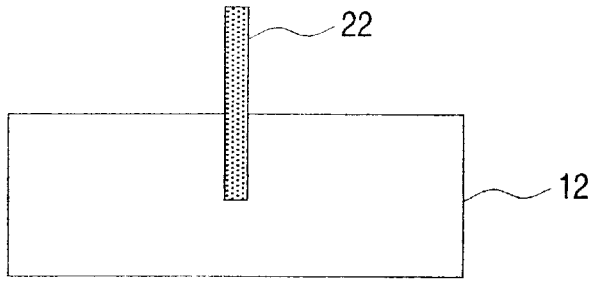
FIG. 5A is a cross-sectional view of the result of a nailing application performed according to the present invention.

By way of example, FIG. 5A shows the result of a "nailing" operation in which inner conductor 22 has disconnected from the concentrator so as to remain inserted in material 12 as a projecting nail. This allows permanent fixing of nails firmly and permanently within materials such as marble, ceramics and brick into which nails cannot readily be inserted by conventional techniques. A particular example of an application of this type would be the insertion of metallic components into dielectric substrates such as ceramics for use in the electronics industry.

Figure 5B:
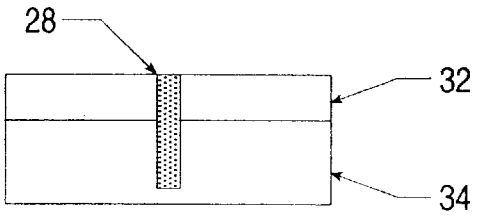
FIG. 5B is a cross-sectional view of two solid bodies joined together according to a joining application of the present invention.

FIG. 5B shows a further application in which the device has been used to form a hole through two abutting sheets 32 and 34 of non-conductive material and the combined inner conductor 22 and dielectric sleeve 28 have been left in place as a "dowel joint". This provides extremely strong joining of sheets 32 and 34. The connection may be further enhanced by melting of sleeve 28 which then fuses with the surrounding material to give a soldered effect.

Figure 5C:
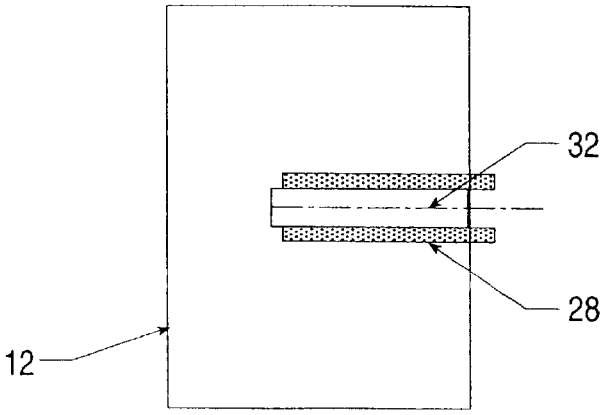
FIG. 5C is a cross-sectional view of the result of a lined-hole application performed according to the present invention.

In drilling applications, at least inner conductor 22 is removed from the hole after drilling. Sleeve 28 may optionally be left in place as a dibble or an inner ceramic coating, as shown in FIG. 5C.

Referring briefly to FIGS. 10A–10D, it should be noted that unlike conventional mechanical drilling techniques, the present invention is not limited to forming circular holes. Thus, in addition to the simple circular form of FIG. 10A, inner conductor 22 can take a wide range of cross-sectional forms. By way of example, FIGS. 10B, 10C and 10D show, respectively, a rectangular, triangular and a star-shaped inner conductor 22 each of which may be used in drilling, nailing and other applications, as described above. Such non-circular shapes provide abutment surfaces which can lock a correspondingly shaped element, or inner conductor 22 itself when left inserted, against axial rotation.

Turning now to the remaining features of microwave device 10, microwave source 14 may be any type of microwave source which provides a power and frequency appropriate for the required application. Examples of suitable microwave sources include, but are not limited to, magnetrons, klystrons, TWT's, and solid-state microwave sources. By way of illustration, a wide range of applications may be performed using a standard microwave source designed for domestic or industrial use. Thus, a device employing a standard 1 kW magnetron source has been demonstrated to drill holes in concrete blocks, forming a hole of 3 cm depth and 0.5 cm diameter in about one minute.

The type and structure of waveguide 16 can readily be selected by one of ordinary skill in the art according to the power and microwave frequency employed, as well as the details of the particular intended application. Examples of suitable waveguides include, but are not limited to, metallic hollow waveguides, coaxial waveguides and transmission lines, quasi-TEM waveguides, and combinations of transmission lines and waveguides.

In addition, matching elements may be used to attain the optimal microwave power in concentrator 18. The matching elements can by pre-set, such as metallic bars or diaphragms, or tunable such as moveable metallic bars and/or plates. Optionally, tunable matching elements are adjusted in an adaptive manner such as under feedback control to obtain an optimal energy flow under the varying conditions during drilling progress.

Turning now to FIGS. 6–9, it should be noted that device 10 may be implemented either in split-unit form or as a single unit. These two possibilities are represented schematically in FIGS. 6 and 7, respectively.

Figure 6:
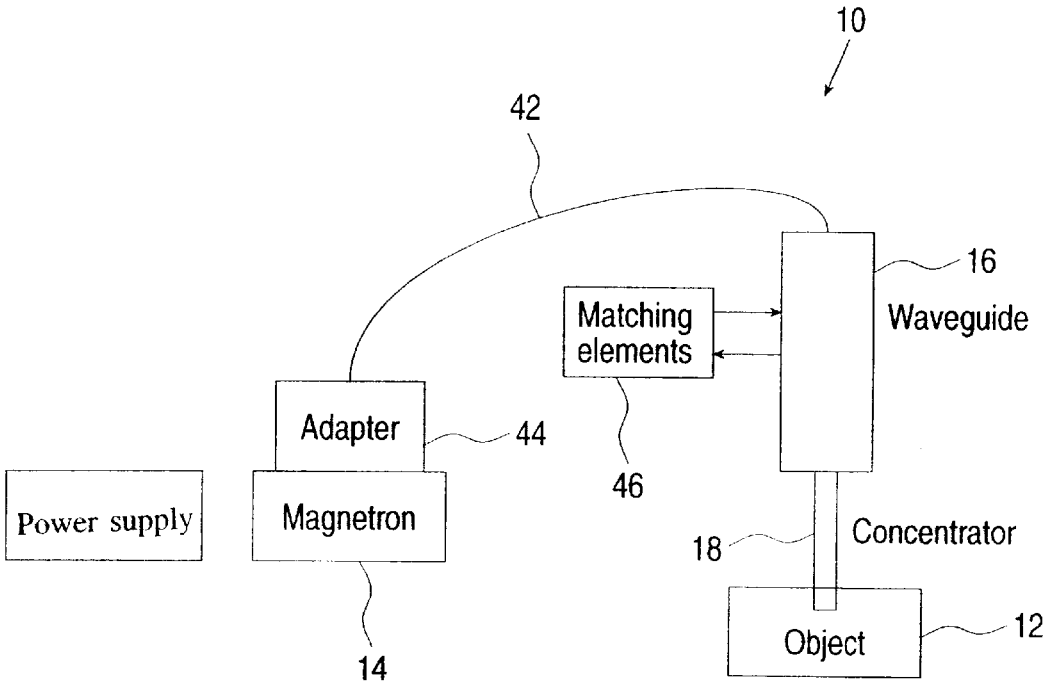
FIG. 6 is a block diagram of a split-unit embodiment of the device of FIG. 1.

Thus, FIG. 6 shows a split-unit implementation of device 10 in which the drilling head 40 is separate from microwave source 14. The microwave power is transmitted through a flexible coaxial cable 42 which is connected to source 14 through an appropriate adapter 44. Drilling head 40 here includes waveguide 16 with its matching elements 46 configured to maximize the radiation in concentrator 18. This split-unit arrangement ensures that drilling head 40 is compact and easy to maneuver.

Figure 7:
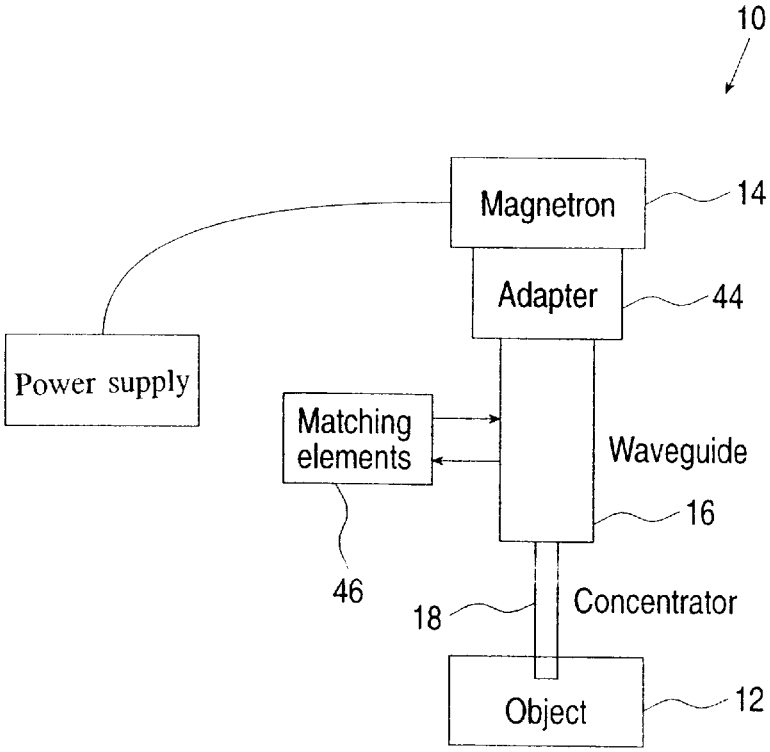
FIG. 7 is a block diagram of a single-unit embodiment of the device of FIG. 1.

FIG. 7, on the other hand, shows a single unit implementation of device 10 in which the drilling head and microwave source are integrated. This makes the unit bulkier and heavier, but it may introduce some advantages in specific applications when a single compact unit is required, or where use of flexible waveguides is not possible.

Figure 8A:
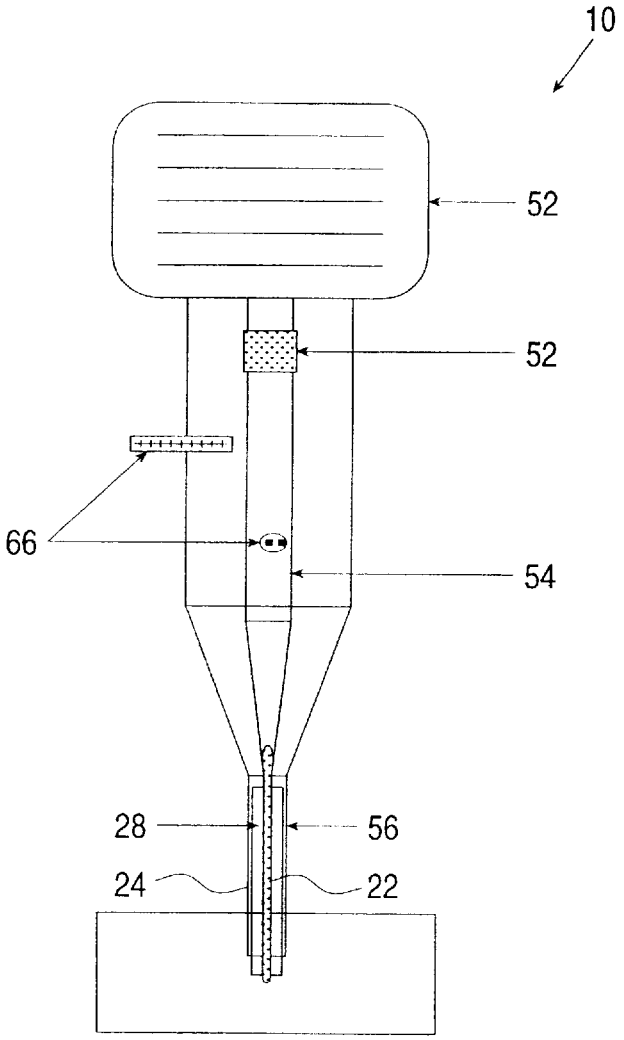
FIG. 8A is a schematic cross-sectional view through a first implementation of the embodiment of FIG. 7.
Figure 8B:
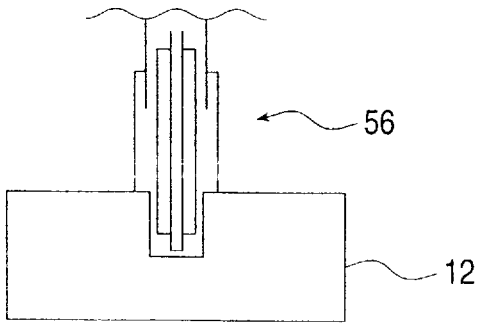
FIG. 8B is a partial view of a variant of the embodiment of FIG. 8A employing a telescopic concentrator.
Figure 9:
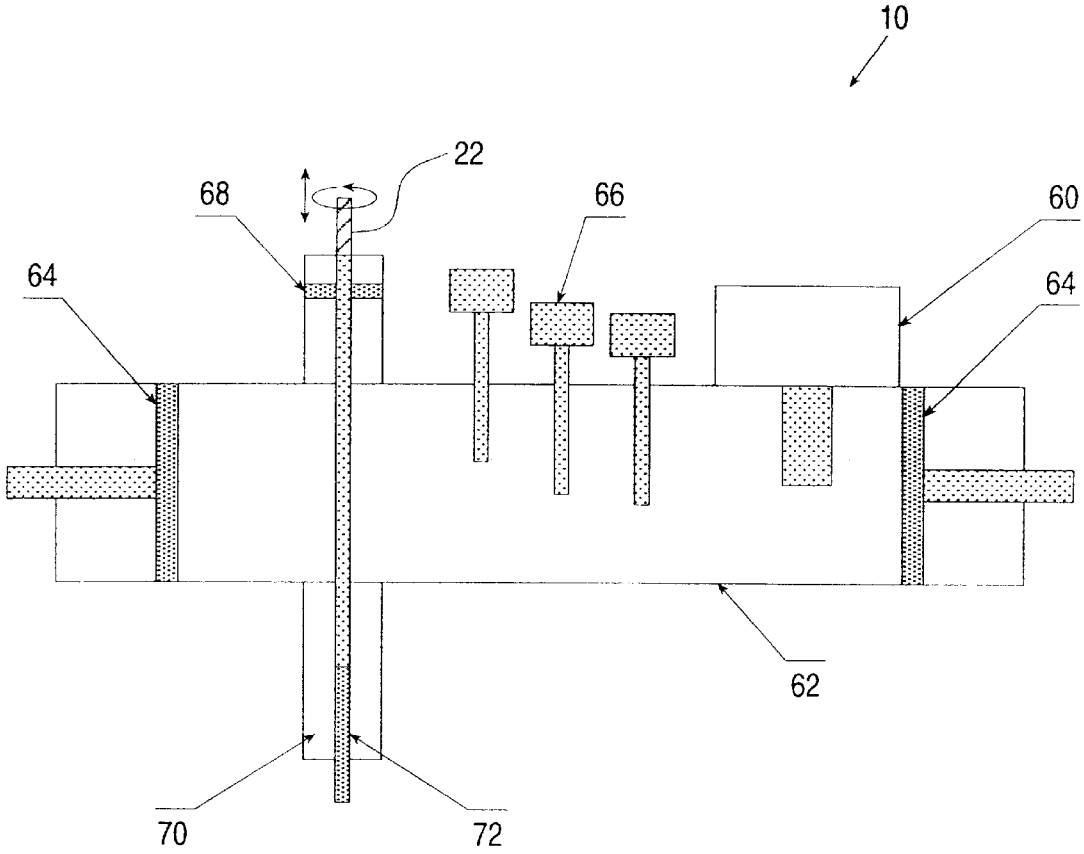
FIG. 9 is a schematic cross-sectional view through a second implementation of the embodiment of FIG. 7.

Two specific single unit implementations are schematically represented in FIGS. 8A and 9. FIG. 8A shows a coaxial structure in which a magnetron source 50 with a coaxial output 52 is connected through a matched coaxial waveguide 54 with matching screws 58 to a concentrator 56. FIG. 8B shows a telescopic variant of concentrator 56 similar to that of FIG. 4.

FIG. 9 shows a waveguide implementation in which device 10 is made up of a magnetron 60 associated with rectangular waveguide 62 which features matching moveable shorts 64 and matching screws 66. An adapter 68 with a moveable short couples between waveguide 62 and a cylindrical coaxial line 70 which connects to a concentrator 72. Adapter 68 is preferably configured to allow attachment of a rotation mechanism (represented schematically by arrow 69) to generate axial rotation of inner conductor 22, alone or together with insulating sleeve 28.

The operation of device 10 in its various implementations, and the corresponding methods or the present invention, will be largely understood from the above description. Microwave radiation generated at source 14 is transferred through waveguide 16 to concentrator 18 which is positioned in close proximity to, and typically in contact with, the solid body. Concentrator 18 concentrates the microwave radiation so that it is absorbed within a small volume of the solid body. This generates heat sufficient to liquefy a volume of the solid body, thereby forming a hole 20 in the solid body. The region onto which the radiation is concentrated preferably has at least one dimension which is at least about an order of magnitude smaller than the wavelength of the radiation.

It will be appreciated that the above descriptions are intended only to serve as examples, and that many other embodiments are possible within the spirit and the scope of the present invention.

What is claimed is:

1. A method for drilling a hole in a non-conductive solid body, the method comprising:

(a) generating microwave radiation; and (b) concentrating the microwave radiation onto a small region of the solid body so as to generate heat sufficient to remove a volume of the solid body, thereby forming a hole in the solid body.

2. The method of claim 1, wherein the small region has substantially circular symmetry.

3. The method of claim 1, wherein the microwave radiation has a given wavelength, the small region having at least one dimension which is smaller than the wavelength.

4. The method of claim 1, wherein the microwave radiation is concentrated by use of a microwave concentrator, said concentrator being formed as a waveguide having at least one inner conductor and an outer conductive sheath surrounding said inner conductor, wherein said outer conductive sheath terminates at an open end and said inner conductor extends beyond said open end.

5. The method of claim 4, wherein the microwave radiation has a given wavelength, said at least one inner conductor having a transverse dimension which is smaller than the wavelength.

6. The method of claim 4, wherein said at least one inner conductor has a central axis and end, a cross-section taken through said at least one inner conductor perpendicular to said central axis at a position proximal to said end exhibiting a non-circular outline.

7. The method of claim 4, wherein said concentrator further includes a dielectric sleeve surrounding at least part of said inner conductor.

8. The method of claim 7, wherein said dielectric sleeve extends beyond said open end.

9. The method of claim 7, wherein said dielectric sleeve substantially fills a volume between said inner conductor and said outer conductive sheath.

10. The method of claim 4, wherein said inner conductor and said outer conductive sheath are coaxial.

11. The method of claim 4, wherein at least a part of said outer conductive sheath adjacent to said open end is telescopically mounted relative to said inner conductor such that a distance of extension of said inner conductor beyond said open end may be varied.

12. The method of claim 11, further comprising retracting said outer conductive sheath relative to said inner conductor so as to increase said distance of extension and advancing said inner conductor into the hole so as to deepen the hole.

13. The method of claim 4, wherein a part of said concentrator is inserted into the hole, further comprising generating rotation of at least said part of said concentrator so as to enhance removal of molten material from the hole.

14. The method of claim 13, wherein said part of said concentrator is formed with an external helical groove configured to enhance removal of molten material from the hole.

15. The method of claim 1, further comprising changing the region onto which the microwave radiation is concentrated so as to extend the hole formed in the solid body.

16. The method of claim 15, wherein the region onto which the microwave radiation is concentrated is changed so as to deepen the hole.

17. The method of claim 1, wherein the microwave radiation is effective to generate a quantity of melted material within the hole, the method further comprising bringing a second solid body into contact with the melted material and allowing the melted material to solidify, thereby welding the second solid body within the hole.

18. The method of claim 17, wherein the second solid body forms at least part of a microwave concentrator used to concentrate the microwave radiation.

19. The method of claim 1, further comprising displacing a location of concentration of said microwave radiation across the solid body so as to enlarge said hole to form an elongated channel.

20. A microwave device for cutting non-conductive materials, the device comprising:

(a) a microwave source of microwave radiation; and (b) concentrator means coupled to said microwave source so as to receive the microwave radiation, said concentrator means being configured to concentrate the microwave radiation onto a small region of the non-conductive material, wherein said concentrator means is formed with at least one inner conductor and an outer conductive sheath surrounding said inner conductor, and wherein said outer conductive sheath terminates at an open end and said inner conductor extends beyond said open end.

21. The microwave device of claim 20, wherein said microwave source generates microwave radiation of a given wavelength, and wherein said concentrator means is configured such that, when placed adjacent to the non-conductive material, a majority of the microwave radiation is directed into a volume of the material lying within a virtual cylinder of diameter equal to half of said wavelength.

22. The microwave device of claim 20, wherein said concentrator means further includes a dielectric sleeve surrounding at least part of said inner conductor.

23. The microwave device of claim 22, wherein said dielectric sleeve is configured to disconnect from said concentrator means such that said dielectric sleeve remains inserted in the material as a hole lining.

24. The microwave device of claim 22, wherein said dielectric sleeve extends beyond said open end.

25. The microwave device of claim 22, wherein said dielectric sleeve substantially fills a volume between said inner conductor and said outer conductive sheath.

26. The microwave device of claim 20, wherein said inner conductor and said outer conductive s heath are coaxial.

27. The microwave device of claim 20, wherein at least a part of said outer conductive sheath adjacent to said open end is telescopically mounted relative to said inner conductor such that a distance of extension of said inner conductor beyond said open end may be varied.

28. The microwave device of claim 20, wherein said inner conductor is configured to disconnect from said concentrator means such that said inner conductor remains inserted in the material as a projecting nail.

29. The microwave device of claim 20, further comprising a rotational drive mechanism associated with said concentrator means so as to generate rotation of at least said inner conductor.

30. The microwave device of claim 29, wherein at least one part of said concentrator means is formed with an external helical groove.

* * * * *